US011458482B2

(12) United States Patent
Li

(10) Patent No.: US 11,458,482 B2
(45) Date of Patent: Oct. 4, 2022

(54) SPIRAL CHUTE FOR MINERAL PROCESSING

(71) Applicant: Chunou Li, Guangzhou (CN)

(72) Inventor: Chunou Li, Guangzhou (CN)

( * ) Notice: Subject to any disclaimer, the term of this patent is extended or adjusted under 35 U.S.C. 154(b) by 0 days.

(21) Appl. No.: 17/422,087

(22) PCT Filed: Oct. 31, 2019

(86) PCT No.: PCT/CN2019/114852
§ 371 (c)(1),
(2) Date: Jul. 9, 2021

(87) PCT Pub. No.: WO2020/143285
PCT Pub. Date: Jul. 16, 2020

(65) Prior Publication Data

US 2022/0097077 A1 Mar. 31, 2022

(30) Foreign Application Priority Data

Jan. 10, 2019 (CN) ..... 201910023315.0

(51) Int. Cl.
*B03B 5/62* (2006.01)
*B03B 5/52* (2006.01)
*B03B 7/00* (2006.01)

(52) U.S. Cl.
CPC ..... *B03B 5/626* (2013.01); *B03B 5/52* (2013.01); *B03B 7/00* (2013.01)

(58) Field of Classification Search
CPC .... B03B 5/02; B03B 5/04; B03B 5/06; B03B 5/26; B03B 5/28; B03B 5/32; B03B 5/38;
(Continued)

(56) References Cited

U.S. PATENT DOCUMENTS 3,891,546 A * 6/1975 Humphreys ..... B03B 5/626 209/159
4,324,334 A * 4/1982 Wright ..... B03B 5/626 209/459

(Continued)

FOREIGN PATENT DOCUMENTS

AU 2012292866 A1 * 3/2014 ..... B03B 5/626
CA 1200789 2/1986

(Continued)

OTHER PUBLICATIONS

International Search Report issued for International Patent Application No. PCT/CN2019/114852, dated Jan. 23, 2020, 8 pages including English translation.

(Continued)

*Primary Examiner* — Gene O Crawford
*Assistant Examiner* — Muhammad Awais
(74) *Attorney, Agent, or Firm* — Hamre, Schumann, Mueller & Larson, P.C.

(57) ABSTRACT

A spiral chute for mineral processing, comprising a spiral chute body (10) supported to be vertical. A radial cross-sectional profile curve of the chute body gradually rises from the inside of the chute body to the outside of the chute body. The radial cross-sectional profile curve of the chute body is a compound curve (100). The compound curve comprises a first curve segment (110) and a second curve segment (120) sequentially arranged from the inside of the chute body to the outside of the chute body. The tail end of the first curve segment and the head end of the second curve segment are connected to a first connection point (130). The included angle between the curve tangent of the head end of the second curve segment and the horizontal plane is smaller than that between the curve tangent of the tail end of the first curve segment and the horizontal plane. The spiral chute for mineral processing can not only outwardly expand and thin (Continued)

a high dune wall to improve the looseness of mineral particles, but also increase the handling capacity per hour, so that the mineral processing efficiency and effect are better.

7 Claims, 7 Drawing Sheets

(58) Field of Classification Search
CPC .... B03B 5/48; B03B 5/52; B03B 5/58; B03B 5/62; B03B 5/72; B03B 5/74; B03B 5/626; B03B 7/00; B07B 13/11; B07B 13/13; B65G 11/06; B65G 11/063; B65G 11/066
USPC ..... 209/484, 479, 506; 193/12, 13
See application file for complete search history.

(56) References Cited

U.S. PATENT DOCUMENTS 4,476,980 A * 10/1984 Giffard ..... B03B 5/626 209/459
4,563,279 A * 1/1986 Wright ..... B03B 5/626 210/512.1
4,597,861 A * 7/1986 Wright ..... B03B 5/626 209/459
5,184,731 A * 2/1993 Robertson ..... B03B 5/626 209/459
5,472,096 A * 12/1995 Prinsloo ..... B03B 5/626 209/459
8,813,971 B2 * 8/2014 Cooke ..... B03B 5/626 209/459
2014/0238906 A1 8/2014 Mohanty et al.

FOREIGN PATENT DOCUMENTS

| | | | | | |
|---|---|---|---|---|---|
| CN | 201832705 | U | | 5/2011 | |
| CN | 102240593 | | | 11/2011 | |
| CN | 102240593 | A | * | 11/2011 | |
| CN | 202169208 | U | | 3/2012 | |
| CN | 202169208 | U | * | 3/2012 | |
| CN | 202173986 | U | | 3/2012 | |
| CN | 206082811 | U | | 4/2017 | |
| CN | 206082811 | U | * | 4/2017 | |
| CN | 109731672 | | | 5/2019 | |
| RU | 1192230 | | | 12/1994 | |
| RU | 2169047 | C2 | | 6/2001 | |
| WO | WO-2012174785 | A1 | * | 12/2012 | B03B 5/626 |
| WO | WO-2013020378 | A1 | * | 2/2013 | B03B 5/626 |

OTHER PUBLICATIONS

Office Action issued for Indian Patent Application No. 202117035463, dated Feb. 25, 2022, 5 pages.
Office Action issued for Russian Patent Application No. 2021121763/03(045494), dated Dec. 29, 2021, 9 pages including partial English translation.
Office Action issued for Australian Patent Application No. 2019421303, dated Apr. 26, 2022, 3 pages.

* cited by examiner

SPIRAL CHUTE FOR MINERAL PROCESSING

TECHNICAL FIELD

The present invention relates to the technical field of gravity separation equipment, in particular to a spiral chute for mineral separation.

BACKGROUND

The spiral chute for mineral separation is a mineral separator which physically separates minerals under an action of centrifugal force and compound gravity field based on different density and specific gravity of mineral grains and looseness of mineral grain membrane flow. The separation effect is directly determined by a chute body of the spiral chute for mineral separation. If the traditional spiral chute for mineral separation is applied during the mineral separation, a "high sand dune wall", formed by the accumulation of coarse mineral grains when a pulp concentration increases to a certain degree, will usually move in a spirally tangent direction at a radial central place of the chute body. This will cause poor loose state among the mineral grains, and prevent the heavy mineral grains outside the chute body from moving towards an inside of the chute body, thereby limiting maximum feeding volume and hourly throughput. A utility model discloses a rotary spiral chute or a spiral pendulum chute with mechanical force, in order to hopefully solve this problem in a targeted manner, and thus obtain the improvement effect. However, the mechanical force is applied to increasing the centrifugal force of the spiral chute, so as to throw the "high sand dune wall" out of the chute body to improve the looseness of the mineral grains. Meanwhile, the heavy mineral grains inside the chute body offset to the outside of the chute body under the same centrifugal force, which increases the proportion of heavy minerals in an intermediate mixed mineral zone (namely intermediate mineral) between a heavy mineral enrichment zone and a light mineral tailings zone, and thus increases the re-separation times of the intermediate mineral and improves the energy consumption cost.

SUMMARY

On this basis, the present invention provides a spiral chute for mineral separation to overcome the defects of the prior art, which can expand a 'high sand dune wall' to be thinner outwards, improve the looseness of mineral grains, and increase the hourly throughput, thereby realizing the better mineral separation efficiency and effect.

A spiral chute for mineral separation is provided, comprising a spiral chute body which is supported to be upright, wherein: a radial cross section curve of the chute body gradually raises from an inside to an outside of the chute body; the radial cross section curve of the chute body is a complex curve; the complex curve comprises a first curve segment and a second curve segment, both of which are sequentially arranged from the inside to the outside of the chute body; and a tail end of the first curve segment and a head end of the second curve segment are connected to a first connection point, and an angle between a curve tangent of the head end of the second curve segment and the horizontal plane is smaller than an angle between a curve tangent of the tail end of the first curve segment and the horizontal plane.

For the spiral chute for mineral separation, the radial cross section curve of the chute body is a complex curve which gradually raises from the inside to the outside of the chute body; the complex curve comprises a first curve segment and a second curve segment, both of which are sequentially arranged from the inside to the outside of the chute body, and the tail end of the first curve segment and the head end of the second curve segment are connected to a first connection point. At the design time, the first connection point is arranged at an approximate part of the chute body according to the actual needs. The head end of the second curve segment is more gentle and thus reduces the resistance against the centrifugal force of pulp movement due to the fact that the angle between the curve tangent of the head end of the second curve and the horizontal plane is smaller than the angle between the curve tangent of the tail end of the first curve segment and the horizontal plane, namely, the head end of the second curve segment, relative to the tail end of the first curve segment, has an anglular inflection at the first connection point. This is conducive to pulp movement out of the chute body, dilution of the accumulated pulp, and looseness increasing of the flow membrane grains, thereby realizing the better separation effect.

In one of embodiments, the first curve segment comprises a first curve segment starting segment and a first curve segment tail segment, both of which are sequentially arranged from the inside to the outside of the chute body; and a tail end of the first curve segment starting segment and a head end of the first curve segment tail segment are connected to a second connection point, the tail end of the first curve segment tail segment and the head end of the second curve segment are connected to the first connection point, and an angle between a curve tangent of the tail end of the first curve segment starting segment and the horizontal plane is smaller than an angle between a curve tangent of the head end of the first curve segment tail segment and the horizontal plane. At the design time, the second connection point is arranged at a zoning place between the heavy mineral grains and the light mineral grains. The angle between the curve tangent of the tail end of the first curve segment starting segment and the horizontal plane is small, and thus is conducive to improving the centrifugal force of the pulp inside the chute body. An angle between the curve tangent of the head end of the first curve segment tail segment and the horizontal plane is big and has sufficient resistance against the heavy mineral grains, so that the centrifugal force strength will not allow the heavy mineral grains to easily cross the chute surface area corresponding to the first curve segment tail segment, but can allow light mineral grains to easily cross the chute area corresponding to the first curve segment tail segment to enter the chute surface area corresponding to the second curve segment. In this way, the heavy and light mineral grains are zoned clearly to beneficially improve the separation efficiency and effectively separate the minerals.

In one of embodiments, the complex curve is composed of the first curve segment starting segment, the first curve segment tail segment and the second curve segment, and the first curve segment starting segment, the first curve segment tail segment and the second curve segment are a cubic parabola. The slopes of the first curve segment starting segment and the first curve segment tail segment progressively increase from the inside to the outside of the chute body steadily, and the slope of the second curve segment, less than the slope of the first curve segment tail segment, progressively increases from the inside to the outside of the chute body again steadily, which is beneficial for mineral separation.

In one of embodiments, a chute surface of the chute body is provided with a heavy mineral grains outflow prevention structure, and the heavy mineral grains outflow prevention structure is arranged in a chute surface area corresponding to the first curve segment tail segment. The heavy mineral grains outflow prevention structure is applied to further decreasing the heavy mineral grains moving towards the outside of the chute body, so as to improve the separation efficiency.

In one of embodiments, a chute surface of the chute body is provided with a separation structure for promoting the heavy mineral grains to move towards the inside of the chute body, and the separation structure is arranged in a chute surface area corresponding to the second curve segment. The separation structure is applied to further separating the heavy mineral grains from the light mineral grains, so as to improve the separation quality.

In one of embodiments, the separation structure comprises a plurality of arc-shaped raised blocking dams arranged around a center of the chute body and a plurality of arc-shaped grooves arranged around the center of the chute body, the plurality of arc-shaped raised blocking dams correspond to the plurality of arc-shaped grooves in a one-to-one manner, the arc-shaped raised blocking dams are arranged at one sides, away from the center of the chute body, of the arc-shaped grooves, and upstream faces of the arc-shaped raised blocking dams are arranged adjacent to side walls of the arc-shaped grooves; and a horizontal distance between each of the arc-shaped raised blocking dams and a spiral central axis of the chute body gradually decreases from the outside to the inside of the chute body, a height of each of the arc-shaped raised blocking dams gradually decreases to flush with the chute surface of the chute body from the outside to the inside of the chute body, and a horizontal distance between each of the arc-shaped grooves and the spiral central axis of the chute body gradually decreases from the outside to the inside of the chute body. For the heavy mineral grains, the heavy mineral grains move towards the inside of the chute body under a combined action of the arc-shaped raised blocking dams and the arc-shaped grooves. With light action from the arc-shaped raised blocking dams and the arc-shaped grooves, the light mineral grains move without being affected substantially, and thus can move towards the outside of the chute body smoothly. Moreover, the pulp will bounce once while encountering one arc-shaped raised blocking dam, and the heavy mineral grains moving against the chute surface will be sputtered to the inside of the chute body to move a small segment of distance while colliding with the arc-shaped raised blocking dams. The pulp passes through the plurality of arc-shaped raised blocking dams sequentially, which is equivalent to moving towards the inside of the chute body through multiple frequencies. Hence, the mineral separation effect is good.

In one of embodiments, the spiral chute for mineral separation further comprises a center column, wherein the chute body is arranged on the center column to realize the secure mounting of the chute body.

In one of embodiments, the spiral chute for mineral separation further comprises a support frame, wherein he chute body is arranged on the support frame to realize the secure mounting of the chute body.

REFERENCE SIGNS

Figure 1:
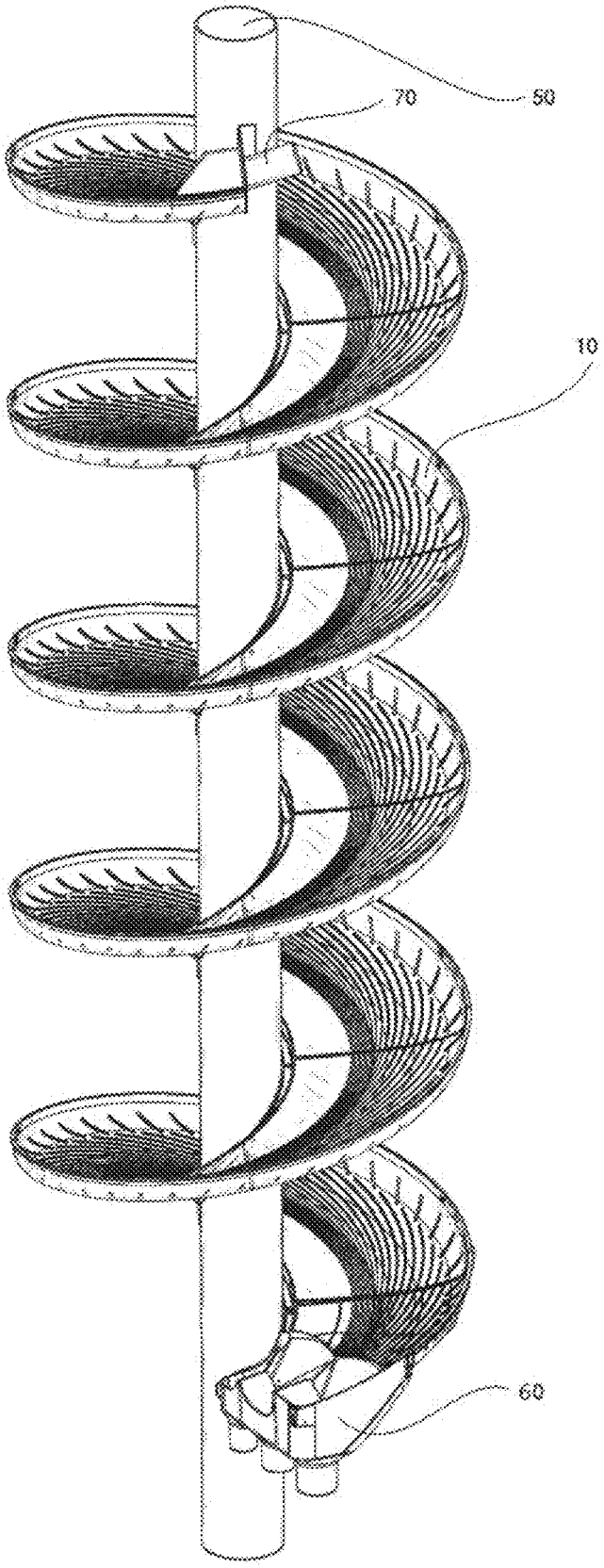
FIG. 1 is a structural schematic view of a spiral chute for mineral separation according to the embodiments of the present invention.

10. chute body; 100. complex curve; 110. first curve segment; 111. first curve segment starting segment; 112. first curve segment tail segment; 113. second connection point; 120. second curve segment; 130. first connection point; 20. heavy mineral grains outflow prevention structure; 200. spiral ladder stage; 30. separation structure; 300. arc-shaped raised blocking dam; 310. arc-shaped groove; 40. pulp desliming and deceleration structure; 400. arc-shaped desliming and deceleration strip; 50. center column; 60. unloading bucket; 70. feeding box.

DESCRIPTION OF EMBODIMENTS

For ease of understanding, the present invention will be described in the following paragraphs more fully with reference to the accompanying drawings. The preferred implementations of the present invention are given in the accompanying drawings. The present invention may, however, be embodied in many different forms and should not be construed as limited to the implementations set forth herein. Rather, these implementations are provided so that the present invention will be thorough and complete, and will fully convey the scope of the present invention to those skilled in the art.

It should be noted that, when an element is known as "fixed to" another element, it can be directly arranged on another element or may have a centering element. When an element is deemed as "connected to" another element, it can be applicable to being directly connected to another element or may have a centering element. On the contrary, when an element is known as "directly connected to "another element", it has no intermediate element. As used herein , the terms "vertical", "horizontal", "left", "right" and similar expressions are only for illustrative purposes, and do not express the exclusive implementations.

Unless otherwise defined, all technical and scientific terms used herein have the same meanings as those generally understood by those killed in the part belonging to the technical field of the present invention. All terms used in the Description of the present invention only aim to describe the specific implementations, rather than limiting the present invention. The terms "and/or" used herein comprise any or a plurality of related items and the combination thereof.

As shown in FIGS. 1-5, in one embodiment, a spiral chute for mineral separation is provided, comprising a spiral chute body 10 which is supported to be upright, wherein a radial cross section curve of the chute body 10 gradually raises from an inside to an outside of the chute body 10; the radial cross section curve of the chute body 10 is a complex curve 100; the complex curve 100 comprises a first curve segment 110 and a second curve segment 120, both of which are sequentially arranged from the inside to the outside of the chute body 10; a tail end of the first curve segment 110 and a head end of the second curve segment 120 are connected to a first connection point 130, and an angle between a curve tangent of the head end of the second curve segment 120 and the horizontal plane is smaller than an angle between a curve tangent of the tail end of the first curve segment 110 and the horizontal plane.

Figure 5:
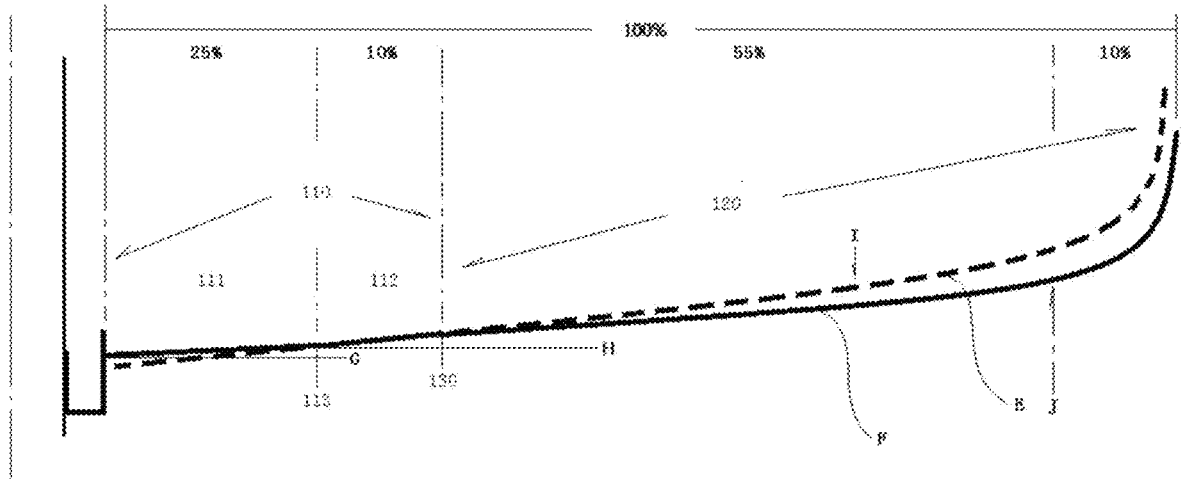
FIG. 5 is a schematic diagram of a spiral chute for mineral separation according to the embodiments of the present invention.

As shown in FIG. 5, a curve E is the radial cross section curve (cubic parabola) of the chute body 10 of the traditional spiral chute for mineral separation, the radial cross section curve of the chute body 10 gets steeper gradually from the inside to the outside of the chute body 10. A curve F is the radial cross section curve (complex curve 100) of the chute body 10 of the spiral chute for mineral separation in this embodiment. For the spiral chute for mineral separation, the radial cross section curve of the chute body 10 is a complex curve 100 which gradually raises from the inside to the outside of the chute body 10; the complex curve 100 comprises a first curve segment 110 and a second curve segment 120, both of which are sequentially arranged from the inside to the outside of the chute body 10, and the tail end of the first curve segment 110 and the head end of the second curve segment 120 are connected to the first connection point 130. At the design time, the first connection point 130 is arranged at an approximate part of the chute body 10 according to the actual needs. The head end of the second curve segment 120 is more gentle and thus reduces the resistance against the centrifugal force of pulp movement due to the fact that the angle between the curve tangent of the head end of the second curve 120 and the horizontal plane is smaller than the angle between the curve tangent of the tail end of the first curve segment 110 and the horizontal plane, namely, the head end of the second curve segment 120, relative to the tail end of the first curve segment 110, has an anglular inflection at the first connection point 130. This is conducive to pulp movement out of the chute body 10, dilution of the accumulated pulp, and looseness increasing of the flow membrane grains, thereby realizing the better separation effect.

As shown in FIG. 5, the head end of the second curve segment 120, relative to the tail end of the first curve segment 110, has the anglular inflection at the first connection point 130. The pulp suffers the centrifugal force in the chute surface area corresponding to the second curve segment 120, which is sufficient to allow an extreme position of a solid-liquid boundary to move towards the outside of the chute body 10 to a position J from a position I.

Preferably, the first connection point 130 is arranged on the chute body 10, 60%-70% away from an outer edge of the chute body 10.

It should be noted that, the selection of the angle between the second curve segment 120 and the horizontal plane at the first connection point 130 is associated with a diameter and pitch of the chute body 10, with an extreme position J as the standard that the solid-liquid boundary, for obvious movement of pulp flow membrane grain groups in the chute surface area corresponding to the second curve segment 120, extends towards the outside of the chute body 10.

Figure 4:
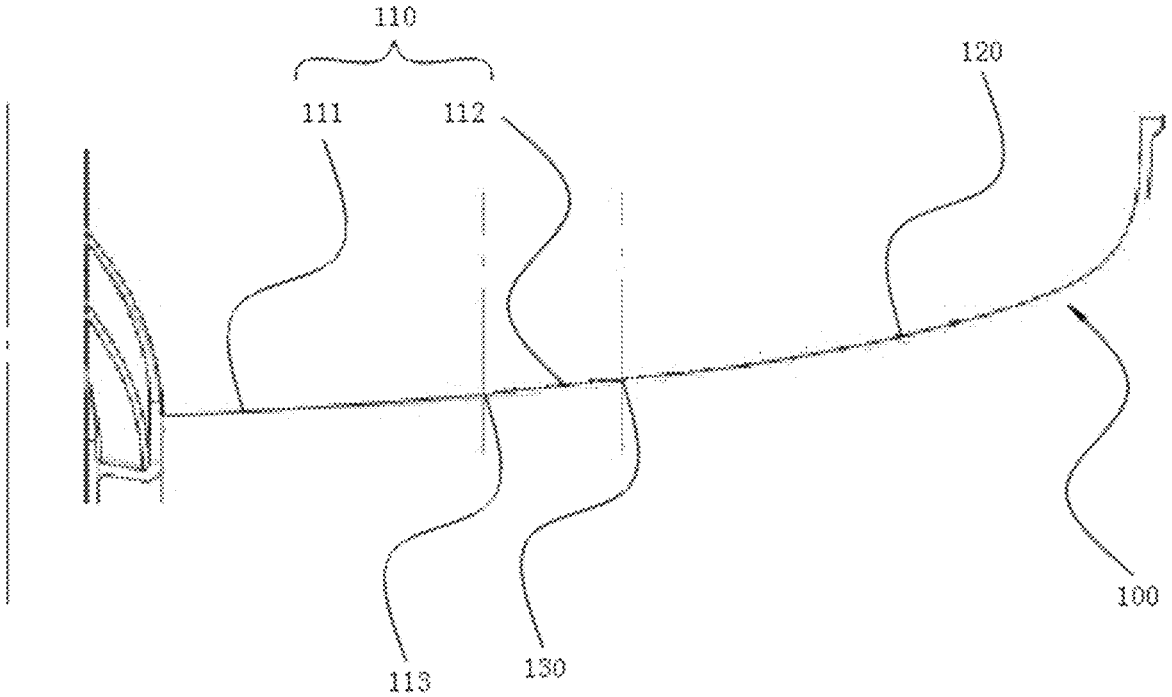
FIG. 4 is a schematic view of a complex curve according to the embodiments of the present invention.

As shown in FIGS. 4 and 5, the first curve segment 110 comprises a first curve segment starting segment 111 and a first curve segment tail segment 112, both of which are sequentially arranged from the inside to the outside of the chute body 10; a tail end of the first curve segment starting segment 111 and a head end of the first curve segment tail segment 112 are connected to a second connection point 113, the tail end of the first curve segment tail segment 112 and the head end of the second curve segment 120 are connected to the first connection point 130, and an angle between a curve tangent of the tail end of the first curve segment starting segment 111 and the horizontal plane is smaller than an angle between a curve tangent of the head end of the first curve segment tail segment 112 and the horizontal plane. At the design time, the second connection point 113 is arranged at a zoning place between the heavy mineral grains and the light mineral grains. The angle between the curve tangent of the tail end of the first curve segment starting segment 111 and the horizontal plane is small, and thus is conducive to improving the centrifugal force of the pulp inside the chute body 10. The angle between the curve tangent of the head end of the first curve segment tail segment 112 and the horizontal plane is big and has sufficient resistance against the heavy mineral grains, so that the centrifugal force strength will not allow the heavy mineral grains to easily cross the chute surface area corresponding to the first curve segment tail segment 112, but can allow the light mineral grains to easily cross the chute area corresponding to the first curve segment tail segment 112 to enter the chute surface area corresponding to the second curve segment 120. In this way, the heavy and light mineral grains are zoned clearly to beneficially improve the separation efficiency and effectively separate the minerals.

Preferably, the second connection point 113 is arranged on the chute body 10, 70%-80% away from the outside of the chute body 10.

Optionally, an angle G between the first curve segment starting segment 111 and the horizontal plane is kept to be 0°-6°, and an angle H between the first curve segment tail segment 112 and the horizontal plane is kept at 3°-9°.

As shown in FIGS. 4 and 5, the complex curve 100 is composed of the first curve segment starting segment 111, the first curve segment tail segment 112 and the second curve segment 120, and the first curve segment starting segment 111, the first curve segment tail segment 112 and the second curve segment 120 are a cubic parabola. The slopes of the first curve segment starting segment 111 and the first curve segment tail segment 112 progressively increase from the inside to the outside of the chute body 10 steadily, and the slope of the second curve segment 120, less than the slope of the first curve segment tail segment 112, progressively increases from the inside to the outside of the chute body 10 again steadily, which is beneficial for mineral separation.

Figure 2:
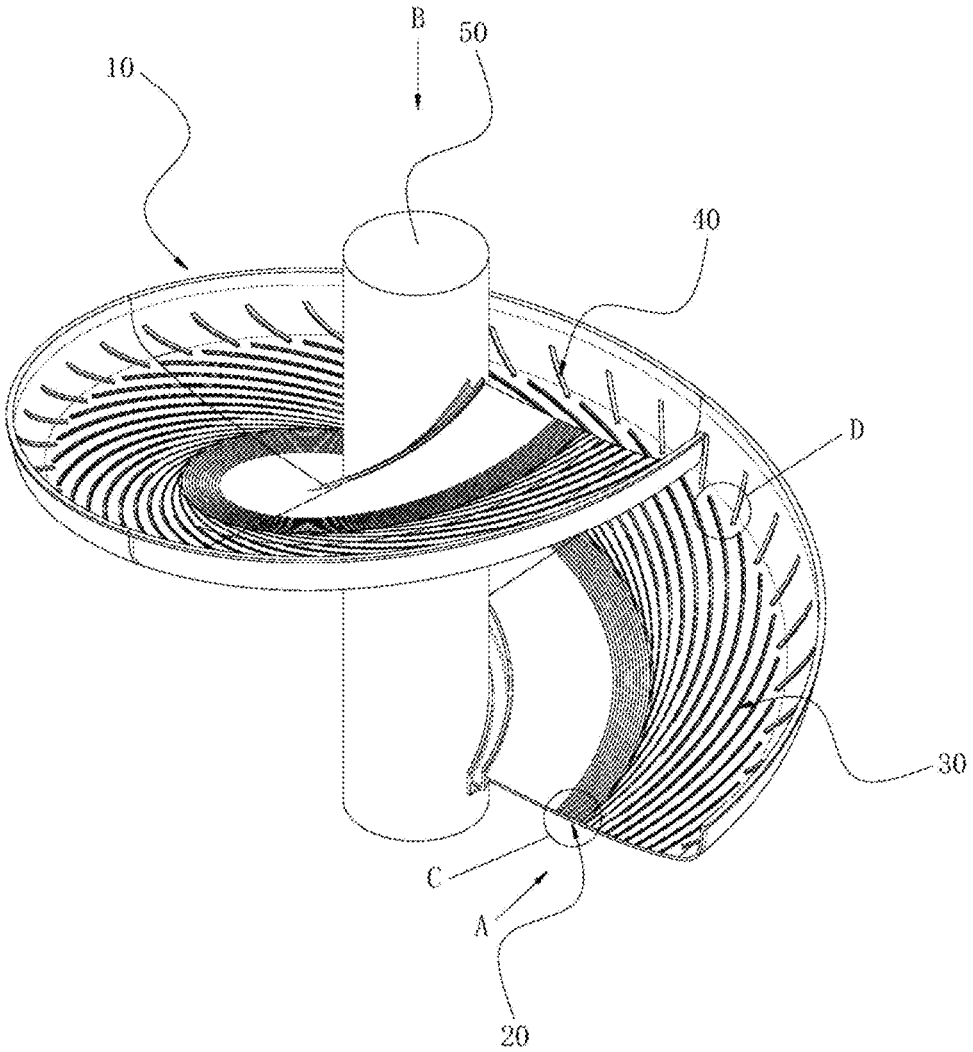
FIG. 2 is a partial schematic view of a spiral chute for mineral separation according to the embodiments of the present invention.
Figure 3:
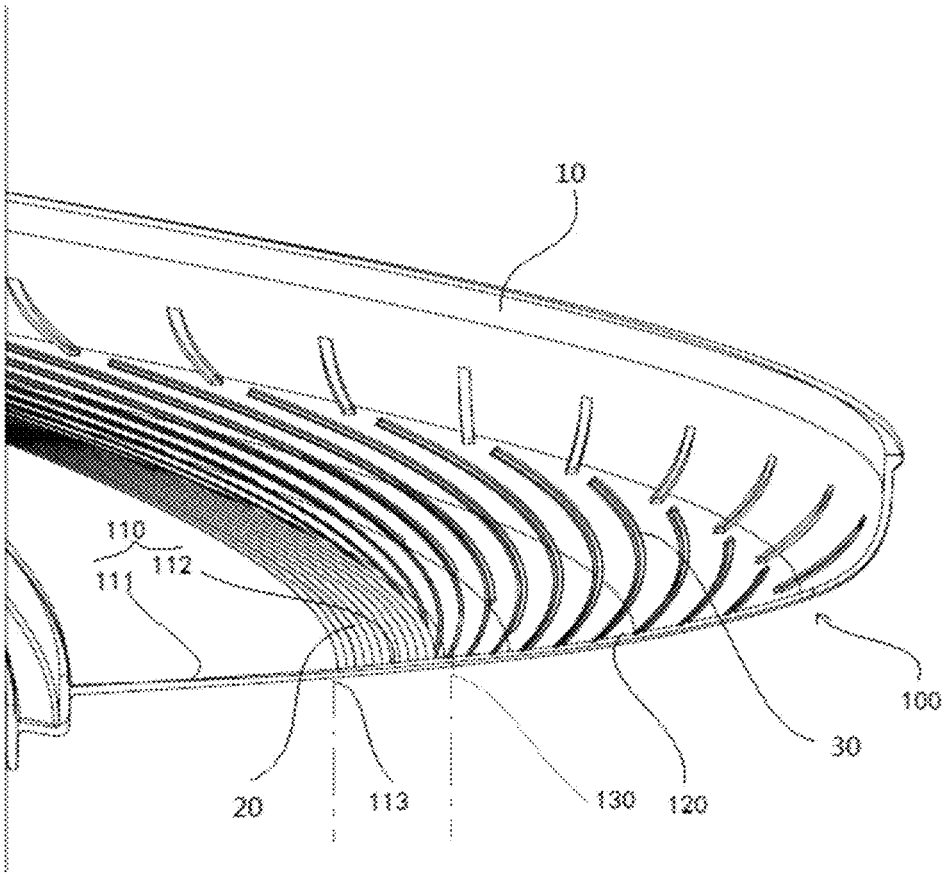
FIG. 3 is a view A in FIG. 2.

As shown in FIG. 2, a chute surface of the chute body 10 is provided with a heavy mineral grains outflow prevention structure 20, and the heavy mineral grains outflow prevention structure 20 is arranged in a chute surface area corresponding to the first curve segment tail segment 112. The heavy mineral grains outflow prevention structure 20 is applied to further decreasing the heavy mineral grains moving towards the outside of the chute body 10, so as to improve the separation efficiency.

Figure 6:
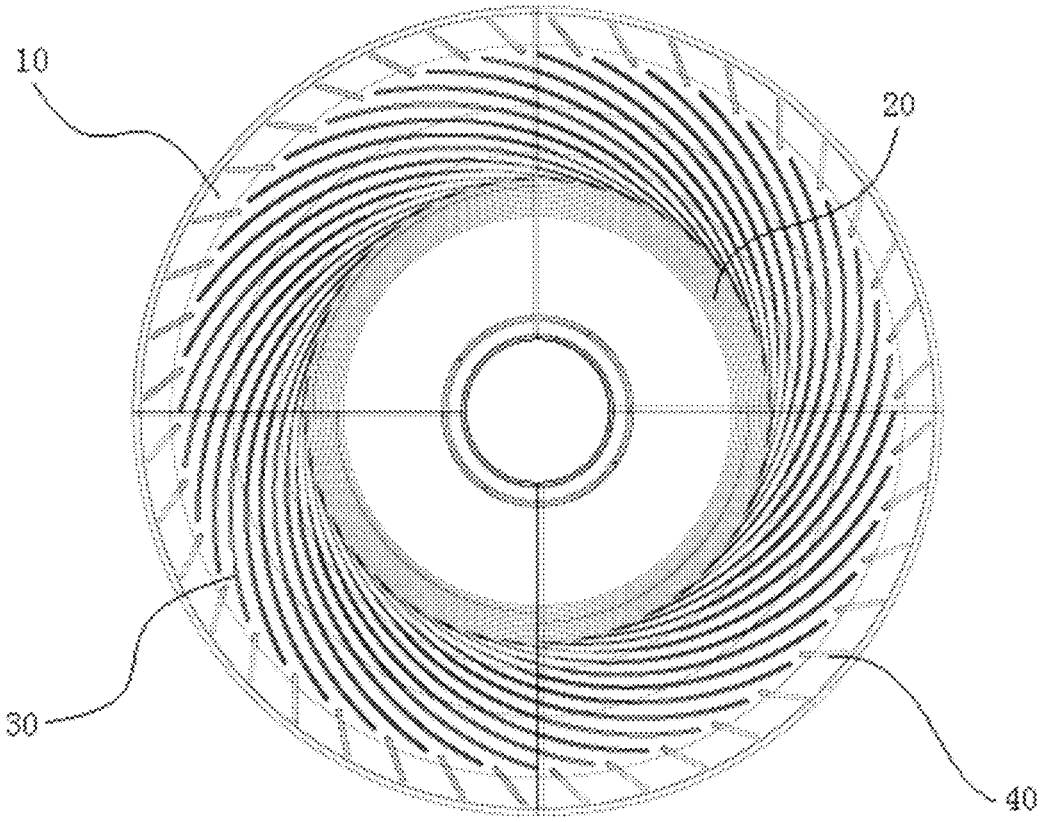
FIG. 6 is a view B in FIG. 2.
Figure 7:
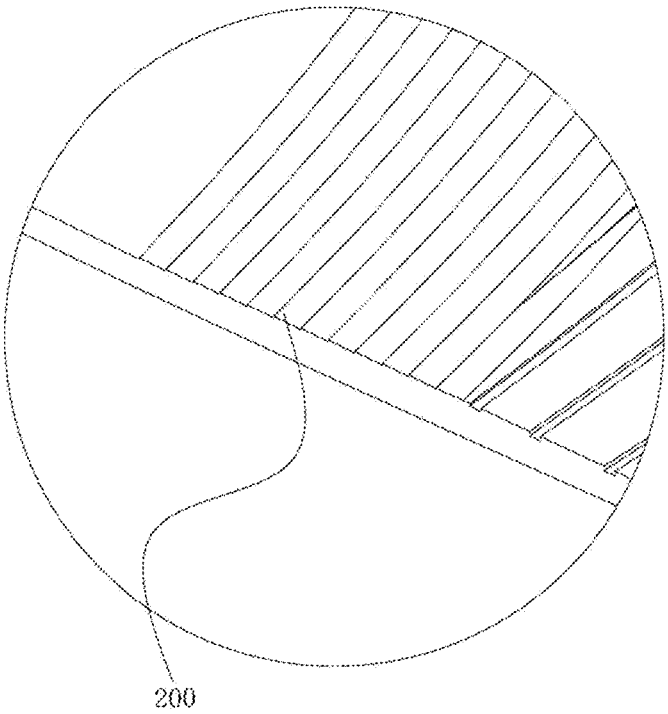
FIG. 7 is an enlarged schematic view of C in FIG. 2.

As shown in FIGS. 6 and 7, the heavy mineral grains outflow prevention structure 20 comprises a spiral ladder stage 200 arranged around a center of the chute body 10, and the spiral ladder stage 200 gradually raises from the inside to the outside of the chute body 10. There is an altitude difference facade between the steps of the spiral ladder stage 200, and the heavy mineral grains move from the outside to the inside of the chute body 10 without any resistance. The heavy minerals will be blocked by multiple altitude difference facades while moving from the inside to the outside of the chute body 10, thereby improving the separation efficiency.

The angle between the second curve segment 120 of the radial cross section curve of the spiral chute for mineral separation in this embodiment and the horizontal plane is smaller than the angle between the corresponding position of the radial cross section curve of the traditional spiral chute for mineral separation and the horizontal plane, which reduces the resistance against the centrifugal force of the pulp movement, and thus is beneficial for the pulp to move towards the outside of the chute body 10. If the chute surface area corresponding to the second curve segment 120 is smooth, the heavy and light mineral grains will move towards the outside of the chute body 10 under an action of the same centrifugal force. To prevent this problem, the following improvements have been made.

As shown in FIG. 2, a chute surface of the chute body 10 is provided with a separation structure 30 for promoting the heavy mineral grains to move towards the inside of the chute body 10, and the separation structure 30 is arranged in the chute surface area corresponding to the second curve segment 120. The separation structure 30 is applied to further separating the heavy mineral grains from the light mineral grains, so as to improve the separation quality.

Figure 8:
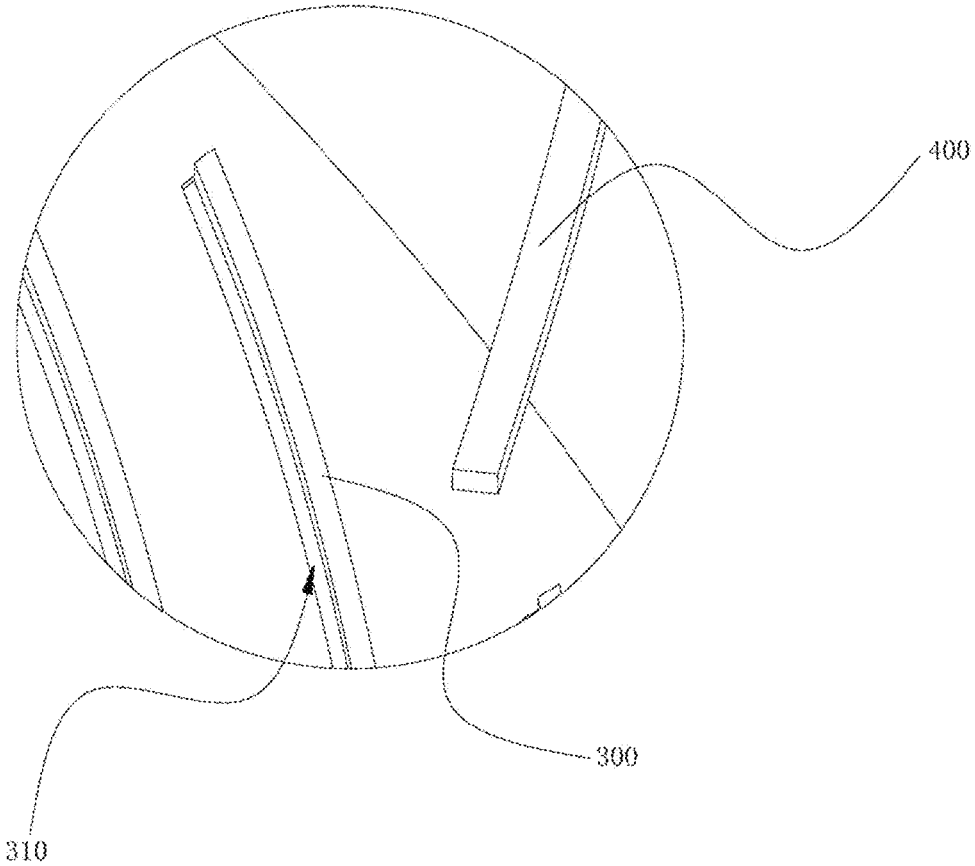
FIG. 8 is an enlarged schematic view of D in FIG. 2.

As shown in FIGS. 6 and 8, the separation structure 30 comprises a plurality of arc-shaped raised blocking dams 300 arranged around a center of the chute body 10 and a plurality of arc-shaped grooves 310 arranged the center of the chute body 10, the plurality of arc-shaped raised blocking dams 300 correspond to the plurality of arc-shaped grooves 310 in a one-to-one manner, the arc-shaped raised blocking dams 300 are arranged at one sides, away from the center of the chute body 10, of the arc-shaped grooves 310, and upstream faces of the arc-shaped raised blocking dams 300 are arranged adjacent to side walls of the arc-shaped grooves 310; a horizontal distance between each of the arc-shaped raised blocking dams 300 and a spiral central axis of the chute body 10 gradually decreases from the outside to the inside of the chute body 10, a height of each of the arc-shaped raised blocking dams 300 gradually decreases to flush with the chute surface of the chute body 10 from the outside to the inside of the chute body 10, and a horizontal distance between each of the arc-shaped grooves 310 and the spiral central axis of the chute body 10 gradually decreases from the outside to the inside of the chute body 10. For the heavy mineral grains, the heavy mineral grains move towards the inside of the chute body 10 under a combined action of the arc-shaped raised blocking dams 300 and the arc-shaped grooves 310. With light action from the arc-shaped raised blocking dams 300 and the arc-shaped grooves 310, the light mineral grains move without being affected substantially, and thus can move towards the outside of the chute body 10 smoothly. Moreover, the pulp will bounce once while encountering one arc-shaped raised blocking dam 300, and the heavy mineral grains moving against the chute surface will be sputtered to the inside of the chute body 10 to move a small segment of distance while colliding with the arc-shaped raised blocking dams 300. The pulp passes through the plurality of arc-shaped raised blocking dams 300 sequentially, which is equivalent to moving towards the inside of the chute body 10 through multiple frequencies. Hence, the mineral separation effect is good.

Preferably, the arc-shaped grooves 310 extend to the chute surface area corresponding to the first connection point 130 from the chute surface area corresponding to the second curve segment 120 from the inside to the outside of the chute body 10, the arc-shaped raised blocking dams 300 extend from the same positions adjacent to the arc-shaped grooves 310 from the outside to the inside of the chute body 10, and a length of each of the arc-shaped raised blocking dams 300 is 70%-80% of a length of each of the arc-shaped grooves 310, namely the arc-shaped raised blocking dams 300 do not extend to the chute surface area corresponding to the first connection point 130 but has flushed with the chute surface of the chute body 10; there has been no arc-shaped raised blocking dam 300 between the flushing place and the chute surface area corresponding to the first connection point 130, but the arc-shaped grooves 310 extend to the chute surface area corresponding to the first connection point 130; the pulp membrane flow velocity in this area has descended gently, the heavy mineral grains, stored at the bottom of the arc-shaped grooves 310, can move to the inside of the chute body 10, so as to be steadily delivered to the chute surface area corresponding to the first curve segment tail segment 112, and further enter the chute surface area corresponding to the first curve segment starting segment 111. Such design is beneficial for the better separation of the heavy mineral grains from the light mineral grains. Optionally, each of the arc-shaped grooves 310 has a depth of 1 mm-3 mm, so that the heavy mineral grains captured outside the chute body 10 may be conveyed to the inside of the chute body 10 well.

As shown in FIGS. 2, 5 and 8, the chute surface of the chute body 10 is provided with a pulp desliming and deceleration structure 40, the separation structure 30 and the pulp desliming and deceleration structure 40 are sequentially arranged in the chute surface area corresponding to the second curve segment 120 from the inside to the outside of the chute body 10. The passing pulp can be strongly scrubbed and decelerated by virtue of the pulp desliming and deceleration structure 40, and the heavy mineral grains carried in the mud are agitated and brushed to be released, and then is captured and delivered to the inside of the chute body 10 by the separation structure 30, and the decelerated liquid pulp moves to the inside of the chute body 10 to moisten the mineral grains accumulated at the extreme position J outside the chute body 10 again due to deceleration, thereby improving the looseness of the grain group and improving the mineral recovery.

As shown in FIG. 8, the pulp desliming and deceleration structure 40 comprises a plurality of arc-shaped desliming and deceleration strips 400 arranged around the center of the chute body 10, and a horizontal distance between the arc-shaped desliming and deceleration strip 40 and a spiral central axis of the chute body 10 gradually decreases from the outside to the inside of the chute body 10. The mud can be reliably separated from the minerals under a vibration action of the arc-shaped desliming and deceleration strip 400. Preferably, a plurality of arc-shaped desliming and deceleration strips 400 are arranged at an angle with the pulp flow direction continuously and equidistantly.

The spiral chute for mineral separation matches the arc-shaped grooves 310 and the arc-shaped raised blocking dams 300 on the chute body 10 formed by complex curve with corner features at the first connection point 130 by virtue of the radial cross section curve, which can provide the strong separation effect equivalent to the mechanical force without the additional mechanical force in a more advanced manner.

It should be noted that the inside of the chute body 10 refers to the interior, adjacent to the spiral central axis, of the chute body 10, and the outside of the chute body 10 refers to the exterior, away from the spiral central axis, of the chute body 10, It should be noted that, the chute surface of the chute body 10 is provided with the heavy mineral grains outflow prevention structure 20, the separation structure 30 and the pulp desliming and deceleration structure 40, and the radial cross section curve of the chute body 10 is partially and slightly fluctuant. The radial cross section curve of the chute body 10 gradually raises from the inside to the outside of the chute body 10, which refers to that the radial cross section curve of the chute body 10 raises integrally from the inside to the outside of the chute body 10. That is to say, as long as the radial cross section curve of the chute body 10 is on the rise from the inside to the outside of the chute body 10, and the head end of the second curve segment 120, relative to the tail end of the first curve segment 110, has the anglular inflection at the first connection point 130, both of which should fall into the scope of protection of the present application.

In this embodiment, the spiral chute for mineral separation further comprises a center column 50, the chute body 10 is arranged on the center column 50 to realize the secure mounting of the chute body 10. In other embodiments, the spiral chute for mineral separation further comprises a support frame, wherein the chute body 10 is arranged on the support frame, which is a feasible scheme.

Optionally, the chute body 10 is made from thermoplastic polymer plastics or glass reinforced plastics.

Besides, the spiral chute for mineral separation further comprises an unloading bucket 60 located at the bottom of the chute body 10 and a feeding box 70 located at the top of the chute body 10.

Figure 9:
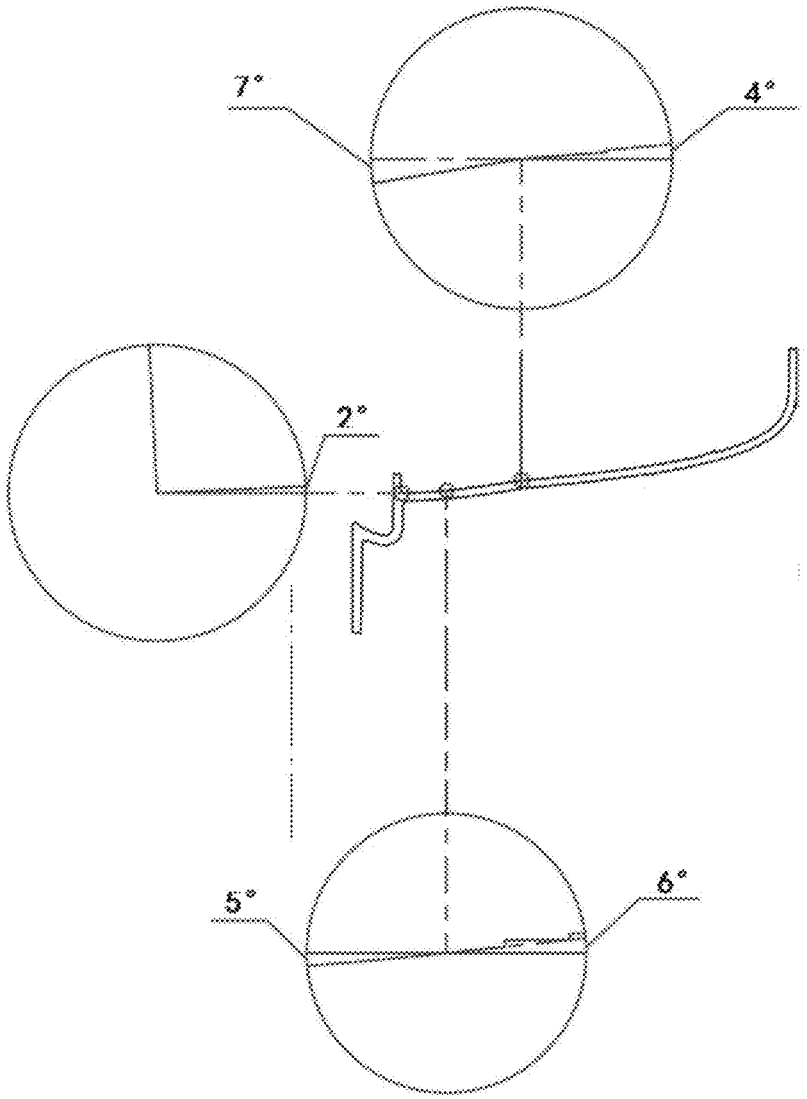
FIG. 9 is a detailed schematic view of a spiral chute for mineral separation according to the embodiments of the present invention.

As shown in FIG. 9, in this embodiment, the chute body 10 has a diameter of 665 mm and a pitch of 420 mm. An angle between the curve tangent of the head end of the first curve segment starting segment 111 and the horizontal plane is 2 degrees, and an angle between the curve tangent of the tail end of the first curve segment starting segment 111 and the horizontal plane is 5 degrees. The second connection point 113 is arranged at a place, 79% away from an outer edge of the chute body 10, of the chute body 10. An angle between the curve tangent of the head end of the first curve segment tail segment 112 and the horizontal plane is 6 degrees, and an angle between the curve tangent of the tail end of the first curve segment tail segment 112 and the horizontal plane is 7 degrees. The first connection point 130 is arranged at a place, 62% away from an outer edge of the chute body, of the chute body 10, and an angle between the curve tangent of the head end of the second curve segment tail segment 120 and the horizontal plane is 4 degrees. The mineral separation test data thereof is as follows:

A. (8 circles) Wolframite provided by a certain tungsten company in Fujian is taken as a test mineral, with original tungsten grade of 0.087%, feeding concentration of 36% ww, solid throughput of 2.8 tph/pcs., and grain size of +0.3 mm~−0.7 mm. Single separation results are as follows: The yield of rough concentrate is 8%, the grade of rough concentrate tungsten is 0.9%, and the rough concentrate recovery is 82%; the concentration ratio is 10 times; the yield of rough middlings is 40%, and the grade of rough tungsten middlings is 0.018%; the yield of rough tailings is 52%, and the grade of rough tungsten tailings is 0.016%.

B. (13 circles) Tin concentrate provided by a certain tin company in Hechi, Guangxi is taken as a test mineral, with tin grade of 4.97%, feeding concentration of 24% ww, and solid throughput of 0.6 tph/pcs. Single separation results are as follows: The yield of tin concentrate is 5.92%, the tin grade of tin concentrate is 57.67%, and the tin concentrate recovery is 68.68%; the concentration ratio is 11.6 times; the grain size distribution of tin concentrate is as follows: +75 um=5.21%, −75 um+40 um=45.32%, −40 um+20 um=41.65%, −20 um+10 um=5.81%, and −10 um=2.01%.

The yield of tin middlings is 5.71%, the tin grade of tin middlings is 6.84%, and the grain size distribution of tin middlings is as follows: +75 um=4.63%, −75 um+40 um=13.7%, −40 um+20 um=49.88%, −20 um+10 um=14.81%, and −10 um=16.98%;

The yield of tin tailings is 88.37%, the tin grade of tin tailings is 1.32%, and the grain size distribution of tin tailings is as follows: +75 um=1.32%, −75 um+40 um=11.22%, −40 um+20 um=17.88%, −20 um+10 um=23.19%, and −10 um=46.39%.

The test data proves that the spiral chute for mineral separation has the mineral separation effect that has leapfrogged over that of international similar advanced equipment in the gravity mineral separation field, even can be as good as the fine slime level mineral separation table. Hence, the chute may replace the jigger even the centrifugal separators, and is very likely to simplify and modify the process flows of the existing mineral separation technology to a great extent, which has an extensive market potential and a value of using new equipment to replace old equipment.

To sum up, the spiral chute for mineral separation is objectively and actually a spiral chute body with a big diameter sleeving a spiral chute body with a small diameter and the same pitch. The two spiral chutes are connected at the first connection point 130 of the radial cross section curve of the chute body 10, and the radial cross section curve has the anglular inflection at the first connection point 130, and they are provided with a targeted functional mineral separation structure respectively. The pulp flows through the two spiral chute bodies to get the obviously different effects, the outside spiral chute body with the big diameter preliminarily separates and scavenges the pulp, and the inside spiral chute body with the small diameter finely selects the heavy mineral grains from the outside.

The spiral chute for mineral separation breaks through various limits that the traditional spiral chute for mineral separation still has, improves and simplifies the technological process of mineral separation, realizes the good low-grade mineral separation effect at the +0.02 mm grade segment, greatly decreases the mineral separation tables, and saves the large-area workshop construction investment, and can also save a large number of floating medicament through pre-separation before flotation, leading to a great influence in environmental protection.

All technical features of the embodiments can be combined arbitrarily. In an attempt to make the description concise, all possible combinations of all technical features in the above embodiments are not depicted. However, combinations of these technical features without contradiction should be regarded as scopes recorded in the Description.

The foregoing embodiments only depict several implementations of the present invention concretely and in details, but cannot be understood as the restriction on the scope of the present invention. It should be noted that, for those of ordinary skilled in the art, some improvements and modifications without departing from the principle of the present invention shall fall into the protection scope of the present invention. Hence, the scope of protection of the present invention shall be subject to the appended claims.

The invention claimed is:

1. A spiral chute for mineral separation, comprising:

a spiral chute body which is supported to be upright, wherein:

a radial cross section curve of the spiral chute body gradually raises from an inside to an outside of the spiral chute body; the radial cross section curve of the spiral chute body is a complex curve; the complex curve comprises a first curve segment and a second curve segment which are sequentially arranged from the inside to the outside of the spiral chute body; and a tail end of the first curve segment and a head end of the second curve segment are connected at a first connection point, and an included angle between a curve tangent of the head end of the second curve segment and a horizontal plane is smaller than an included angle between a curve tangent of the tail end of the first curve segment and the horizontal plane, and wherein:

the first curve segment comprises a first curve segment starting segment and a first curve segment tail segment which are sequentially arranged from the inside to the outside of the spiral chute body; and a tail end of the first curve segment starting segment and a head end of the first curve segment tail segment are connected at a second connection point, the tail end of the first curve segment tail segment and the head end of the second curve segment are connected at the first connection point, and an included angle between a curve tangent of the tail end of the first curve segment starting segment and the horizontal plane is smaller than an included angle between a curve tangent of the head end of the first curve segment tail segment and the horizontal plane.

2. The spiral chute for mineral separation according to claim 1, wherein the complex curve is composed of the first curve segment starting segment, the first curve segment tail segment and the second curve segment, and the first curve segment starting segment, the first curve segment tail segment and the second curve segment are all cubic parabolas.

3. The spiral chute for mineral separation according to claim 1, wherein a chute surface of the spiral chute body is provided with a heavy mineral grains outflow prevention structure, and the heavy mineral grains outflow prevention structure is arranged in a chute surface area corresponding to the first curve segment tail segment.

4. The spiral chute for mineral separation according to claim 1, wherein a chute surface of the spiral chute body is provided with a separation structure for promoting heavy mineral grains to move towards the inside of the spiral chute body, and the separation structure is arranged in a chute surface area corresponding to the second curve segment.

5. The spiral chute for mineral separation according to claim 4, wherein the separation structure comprises a plurality of arc-shaped raised blocking dams arranged around a center of the spiral chute body and a plurality of arc-shaped grooves arranged around the center of the spiral chute body, the plurality of arc-shaped raised blocking dams correspond to the plurality of arc-shaped grooves in a one-to-one manner, each of the arc-shaped raised blocking dams is arranged on one side, away from the center of the spiral chute body, of each of the arc-shaped grooves, and upstream faces of the arc-shaped raised blocking dams are arranged adjacent to side walls of the arc-shaped grooves; and a horizontal distance between each of the arc-shaped raised blocking dams and a spiral central axis of the spiral chute body gradually decreases from the outside to the inside of the spiral chute body, a height of each of the arc-shaped raised blocking dams gradually decreases from the outside to the inside of the spiral chute body until being flush with the chute surface of the spiral chute body, and a horizontal distance between each of the arc-shaped grooves and the spiral central axis of the spiral chute body gradually decreases from the outside to the inside of the spiral chute body.

6. The spiral chute for mineral separation according to claim 1, further comprising a center column, wherein the spiral chute body is arranged on the center column.

7. The spiral chute for mineral separation according to claim 1, further comprising a support frame, wherein the spiral chute body is arranged on the support frame.

* * * * *